US006325320B1

(12) United States Patent
Möller et al.

(10) Patent No.: US 6,325,320 B1
(45) Date of Patent: Dec. 4, 2001

(54) WINDING DEVICE AND PROCESS FOR WINDING A WEB MATERIAL

(75) Inventors: Roland Möller, Herbrechtingen; Werner Leitenberger, Schlier; Jörg Maurer, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/422,086

(22) Filed: Oct. 21, 1999

(30) Foreign Application Priority Data

Oct. 22, 1998 (DE) ..... 198 48 813

(51) Int. Cl.[7] ..... B65H 18/16

(52) U.S. Cl. ..... 242/532.7; 242/542.3; 242/542.4

(58) Field of Search ..... 242/542.4, 542.3, 242/532.7, 541.7

(56) References Cited

U.S. PATENT DOCUMENTS

| | | | | |
|---|---|---|---|---|
| 3,549,098 | * | 12/1970 | Helkala | 242/542.4 |
| 3,552,670 | * | 1/1971 | Herman | 242/542.7 |
| 4,327,877 | | 5/1982 | Perini . | |
| 4,695,004 | | 9/1987 | Grossman et al. . | |
| 5,026,005 | | 6/1991 | Ehrola . | |
| 5,531,396 | | 7/1996 | Kinnunen et al. | 242/526.3 |
| 5,673,870 | | 10/1997 | Fielding et al. | 242/542.3 |
| 5,713,534 | | 2/1998 | McClenathan et al. | 242/542.3 |

FOREIGN PATENT DOCUMENTS

| | | |
|---|---|---|
| 691282 | 5/1940 | (DE) . |
| 3515519 | 10/1986 | (DE) . |
| 4343173 | 6/1995 | (DE) . |
| 19633958 | 10/1997 | (DE) . |
| 19724911 | 12/1998 | (DE) . |
| 29712682 | 9/1997 | (DK) . |
| 0658504 | 6/1995 | (EP) . |
| 658504 | 6/1995 | (EP) . |
| 0791550 | 8/1997 | (EP) . |

* cited by examiner

*Primary Examiner*—John M. Jillions
(74) *Attorney, Agent, or Firm*—Greenblum & Berstein, P.L.C.

(57) ABSTRACT

Winding machine and process for winding a material web, in particular a paper or cardboard web, onto a reel. The material web is guided by a carrying drum that can be supplied with suction, and a nip is formed between the carrying drum and the reel. The carrying drum, which has a perforated casing and/or is provided with circumferential grooves, is supplied with suction by way of at least one external suction box. The suction box is disposed with at least one suction opening opposite the circumference region of the carrying drum that is not wrapped by the material web. The suction box has at least one sealing element that cooperates with the carrying drum in the vicinity of the suction opening.

32 Claims, 3 Drawing Sheets

WINDING DEVICE AND PROCESS FOR WINDING A WEB MATERIAL

CROSS-REFERENCE TO RELATED APPLICATIONS

The present application claims priority under 35 U.S.C. § 119 of German Patent Application No.198 48 813.0, filed Oct. 22, 1998, the disclosure of which is expressly incorporated by reference herein in its entirety.

BACKGROUND OF THE INVENTION

1. Field of the Invention

The invention relates to a winding machine and process for winding a material web, in particular a paper or cardboard web, onto a reel, in which the material web is guided by way of a carrying drum that can be supplied with suction, and a hip formed between the carrying drum and the reel.

2. Discussion of Background Information

A winding machine of this kind has been disclosed, for example, in European Patent EP-B1-0 658 504, wherein a carrying drum is provided with internally supplied suction. A corresponding winding machine is used, for example, at the end of a machine used for producing or refining a material web. It can also be used for wrapping a winding roll that has already been completely wound. Such a machine can, for example, be a paper making machine.

In practice, problems can occur with the initial threading of the material web or a threading end or threading tip of this material web onto the winding device. Thus, until now, it has been customary to transport the threading end of the material web to the carrying drum, by way of threading ropes, blower plates, vacuum belts and/or the like, whereupon this threading end is guided around the carrying drum. Then, the threading end is removed from the carrying drum once more, by way of a doctor (scraper), e.g., a blowing doctor, a blowing wedge, or the like and by way of baffle, and is discarded into a rejects slusher. The paper web then widens out and is continuously discarded into the rejects slusher. For example, a baffle with a blower device can be provided for this purpose. Then, the material web is cut, by way of a gooseneck, band, knife, water jet, and/or the like and is threaded onto an empty reel that is provided. In this regard, an uncontrolled self-threading of the in particular strip-like threading end or the entire material web onto a provided empty reel or an already wound reel can occur. This problem occurs to a greater degree at high machine speeds and with grooved or bored carrying drums that are not supplied with suction.

In conjunction with a conventional winding machine 10, there is shown in FIG. 1 one such undesirable self-threading that deviates from the desired web path A. The web path B represents the case in which, immediately after the nip 18 formed between the carrying drum 12 and an empty reel 16', the strip-like threading end of the material web 14, that is guided by way of the carrying drum 12 or the entire material web 14 is automatically wound in an uncontrolled manner onto the empty reel 16'. The letter C represents the case in which there is an uncontrolled self-threading onto an already wound reel 16. In contrast, in the desired web path A, the threading end or the material web 14 is first detached from the carrying drum 12 by a doctor 20 and is discarded into the rejects slusher 22.

With a carrying drum that is supplied with suction, the guidance of the threading end, which is generally strip-like, or the material web is influenced all the way to the exit region at the doctor 20 so that in this instance, a self-threading onto the still empty reel 16' (instance B) can be prevented. Carrying drums are used for this purpose, that are connected to a vacuum source and are supplied with suction by one or both pins. In the frequently used drum embodiments, the inner chamber is supplied with suction without built-in elements. As a result, however, secondary air can now penetrate into the part of the carrying drum that is not wrapped around, which results in a relatively high energy consumption. Carrying drums with internal sealing have, among other things, the disadvantage that functional elements are disposed inside the carrying drum. The carrying drum must be removed, for example, in the event of a possible change of seals. All of the known embodiments have the disadvantage that a doctor device is also always required in order to remove the threading end or the paper web from the carrying drum.

SUMMARY OF INVENTION

The invention comprises a winding machine of the type mentioned in the Background, which permits a continuously reliable, controlled threading of the threading end of the material web while retaining the simplest possible construction.

This is attained according to the invention by providing the carrying drum with a perforated casing and/or with circumferential grooves. The drum is supplied with suction by means of at least one external suction box which is disposed with at least one suction opening opposite the circumference region of the carrying drum that is not wrapped by the material web. The suction box has at least one sealing element in the vicinity of this suction opening, which cooperates with the carrying drum.

Based on this embodiment, a definite web path is always assured, even with the initial threading of the strip-like threading end of the material web. Thus, an uncontrolled self-threading of the threading end or the entire material web onto an empty reel or a wound reel is prevented. The respectively desired web path is assured even at higher machine speeds. With the use of an external suction box, it is assured in any case that virtually no secondary air penetrates into the carrying drum, which results in a reduced energy consumption. A possible changing of the seals can be carried out in an extremely simple fashion. It is no longer necessary to remove the carrying drum for this purpose. In addition, the previously required additional doctor device can be eliminated. For example, a sealing element, in particular a strip-like sealing element, that is provided in the web exit region of the carrying drum can simultaneously be embodied as a doctor.

Correspondingly, in one embodiment of the winding machine according to the invention, at least one sealing element of the suction box is simultaneously embodied as a doctor.

In a suitable fashion, at least one sealing element is embodied as a sealing strip that extends laterally to the web travel direction. A respective doctor can then be provided in the form of a sealing strip of this kind.

A doctor that is embodied by a sealing element and is provided in the web exit region of the carrying drum can therefore be used to detach the material web guided by means of the carrying dram or a threading end of this material web once more from the carrying drum so that the previously required additional doctor device can be eliminated.

In one practical embodiment, the suction box is provided with sealing strips on the two longitudinal sides extending laterally to the web travel direction. Therefore, it is fundamentally also possible to seal the suction box on both ends by means of sealing strips that constitute doctors.

It is also advantageous if at least one sealing strip, which is provided in the web exit region and is simultaneously embodied as a doctor, can be pneumatically loaded. In so doing, the sealing strip can, for example, be pressed against the carrying drum by means of at least one compressed air hose or the like.

In one practical embodiment of the winding machine according to the invention, the sealing strip can be pivoted around an axis parallel to the drum axis, be supported on a side wall of the suction box, and can be acted upon in opposite directions by way of two compressed air hoses. In particular, different pressures can also be adjusted in this manner.

In one practical embodiment, the suction box extends laterally to the web travel direction at least essentially across the entire machine width.

The suction box can advantageously be acted upon with vacuum by means of an internal tube that is provided with suction openings and can be connected to a vacuum source. The internal tube can extend at least essentially across the entire machine width. The suction openings provided in the casing of this internal tube are suitably provided on the side of the tube oriented toward the carrying drum.

Particularly in terms of the most optimal possible threading of a strip-like threading end of the material web, it is advantageous for the carrying drum and the suction box to be correspondingly subdivided in order to produce an edge suction zone provided in the vicinity of the relevant drum end. Preferably, the internal tube can be used alternatively to apply vacuum either to only the edge suction zone or to the entire suction zone, which extends at least essentially across the entire machine width.

In order to encourage the detachment of the material web, or the threading end of this material web, from the carrying drum, a blower device can be provided in the web exit region. Such a blower device is suitably disposed on a side wall of the suction box.

In a practical embodiment of the winding machine according to the invention, the suction opening of the suction box, which is adjoined by at least one sealing element, extends over at least the entire circumference region of the carrying drum that is not wrapped by the material web.

The carrying drum can be associated with a zone-controlled internal support. Such a zone-controlled internal support can, for example, be realized in the same way as in the suction roll disclosed in German patent DE-A1-196 33 958, the disclosure of which is hereby incorporated by reference. For example, a Nipco roll can be provided in the carrying drum which is, in particular, perforated. The casing of the carrying drum can, on its inside, also be supported by means of at least one internally disposed rotation body with associated slide bearings, as described in DE-U-29712682.2, the disclosure of which is hereby incorporated by reference.

According to the invention, a winding machine for winding a material web, preferably, a paper web or cardboard web, onto a reel comprises a carrying drum for guiding the material web and a nip formed between the carrying drum and the reel. The carrying drum has at least one of, a perforated casing, or circumferential grooves. At least one external suction box is provided for supplying suction to the drum. At least one suction opening is provided opposite the circumference region of the carrying drum that is not wrapped by the material web. At least one sealing element is associated with the suction box for cooperating with the carrying drum in the vicinity of the suction opening.

According to the invention, the at least one sealing element serves simultaneously as a doctor (scraper). The at least one sealing element comprises a sealing strip that extends laterally to a direction of travel of the web. The doctor is provided in a web exit region of the carrying drum to again detach at least a threading end of the material web from the carrying drum.

Sealing strips are provided on both longitudinal sides of the suction box, extending laterally to the web travel direction. The suction box is sealed on both sides by the sealing strips which also serve as doctors (scrapers).

A pneumatic loader is provided for the at least one sealing strip in the web exit region. The pneumatic loader comprises at least one compressed air hose for pressing the at least one sealing strip against the carrying drum. The pneumatic loader further comprises at least one compressed air hose acting upon the at least one sealing strip in a direction away from the carrying drum.

Two compressed air hoses are provided for acting in opposite directions on the at least one sealing strip, the at least one sealing strip being pivotable around an axis parallel to the drum axis and being supported on a side wall of the suction box. The suction box extends laterally to a direction of travel of the web, at least substantially across the entire machine width.

A vacuum source and an internal tube are provided, with suction openings connected to the suction box. The internal tube extends at least substantially across the entire machine width. The suction opening are provided in the casing of the internal tube on the side of the tube oriented toward the carrying drum. The carrying drum has two drum ends, the drum and the suction box being correspondingly subdivided in order to form an edge suction zone in the vicinity of one of the drum ends. The internal tube is alternatively used to apply vacuum either to only the edge suction zone or to the entire suction zone that extends at least essentially across the entire machine width.

There is further provided, according to the invention, a blower device in the web exit region for assisting at least the threading end of the material web to detach from the carrying drum. The blower device is disposed on a side wall of the suction box. The suction opening extends over at least essentially the entire circumference region of the carrying drum that is not wrapped by the material web. Additionally, the carrying drum may be associated with a zone-controlled internal support.

According to the invention, the winding machine for winding a material web onto a reel comprises a carrying drum for guiding the material web and a nip formed between the carrying drum and the reel. The carrying drum has at least one of, a perforated casing, or circumferential grooves. At least one external suction box is provided for supplying suction to the drum. At least one suction opening is provided opposite the circumference region of the carrying drum that is not wrapped by the material web. At least one sealing element is associated with the suction box and cooperates with the carrying drum in the vicinity of the suction opening. A pneumatic loader is provided for the at least one sealing strip in a web exit region, the pneumatic loader comprising at least one compressed air hose for pressing the at least one sealing strip against the carrying drum and at least one compressed air hose acting upon the at least one sealing strip in a direction away from the carrying drum. A vacuum source and an internal tube are provided with suction openings connected to the suction box. A blower device is provided in the web exit region for assisting at least the threading end of the material web to detach from the carrying drum, the blower device being disposed on a side wall of the suction box.

The invention further resides in a process for winding a material web onto a reel. The process comprises guiding the material web onto a carrying drum and moving the reel adjacent the carrying drum to form a nip between the carrying drum and the reel. The carrying drum has at least one of, a perforated casing, or circumferential grooves. The process further comprises supplying suction to the drum from at least one external suction box through at least one suction opening opposite the circumference region of the carrying drum that is not wrapped by the material web, wherein at least one sealing element associated with the suction box cooperates with the carrying drum in the vicinity of the suction opening.

Further, the process comprises having the sealing function serve simultaneously as a scraper function to again detach at least a threading end of the material web from the carrying drum. Additionally, the process comprises pneumatically loading at least one sealing strip in a web exit region. The pneumatic loading comprises pressing the at least one sealing strip against the carrying drum by way of at least one compressed air hose. Further, the pneumatic loading comprises acting upon the at least one sealing strip in a direction away from the carrying drum by way of at least one compressed air hose.

The pneumatic loading comprises acting in opposite directions on the at least one sealing strip by way of two compressed air hoses. At least one sealing strip is pivoted around an axis parallel to the drum axis and is supported on a side wall of the suction box.

The process according to the invention further comprises connecting a vacuum source and an internal tube provided with suction openings to the suction box.

Vacuum is alternatively applied either to only the edge suction zone or to the entire suction zone that extends at least essentially across the entire machine width.

A detaching force is applied to the threading end of the material web from the carrying drum by way of a blower device in the web exit region.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 2:
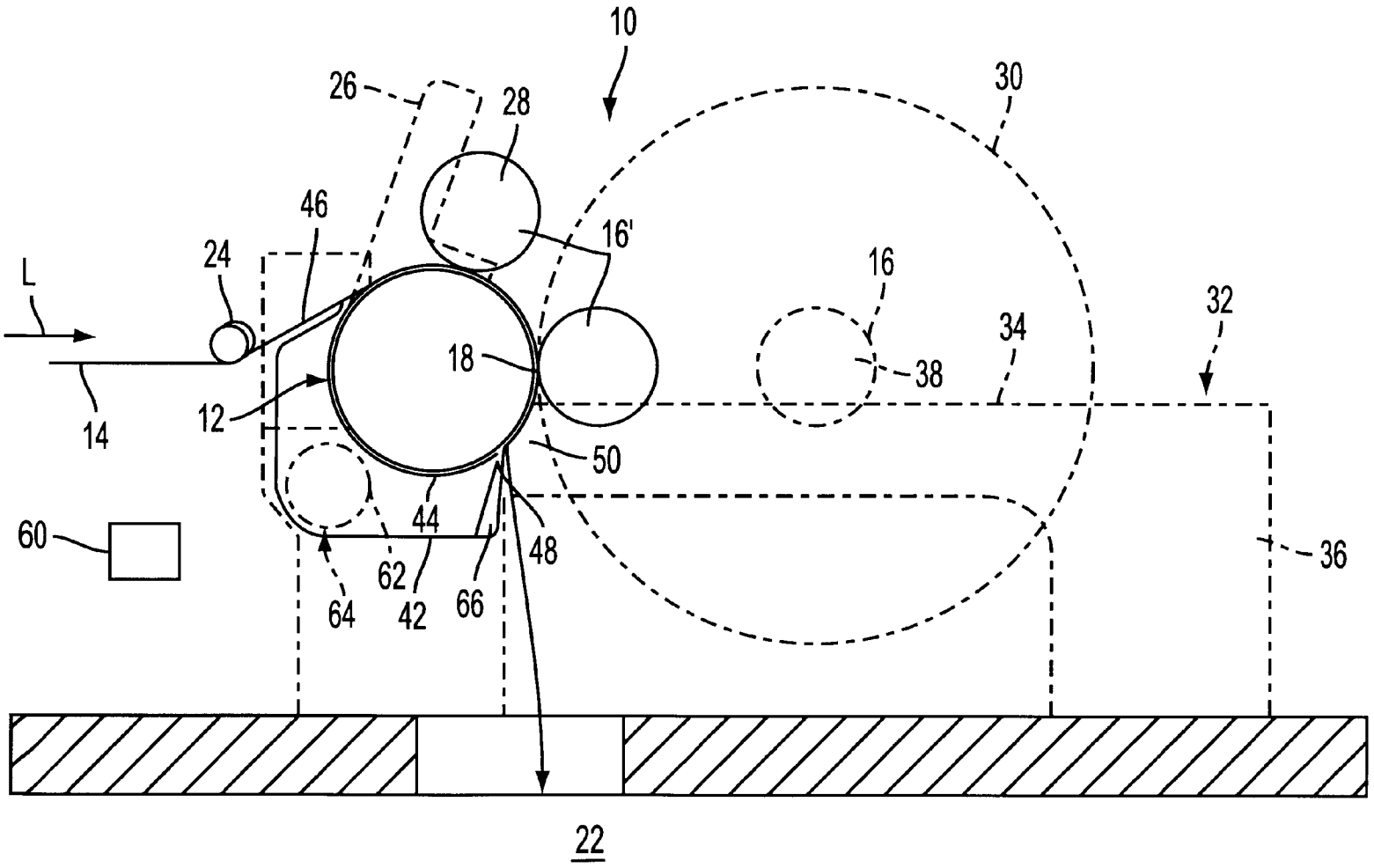
FIG. 2 is a purely schematic representation of an embodiment of the winding machine according to the invention.
Figure 3:
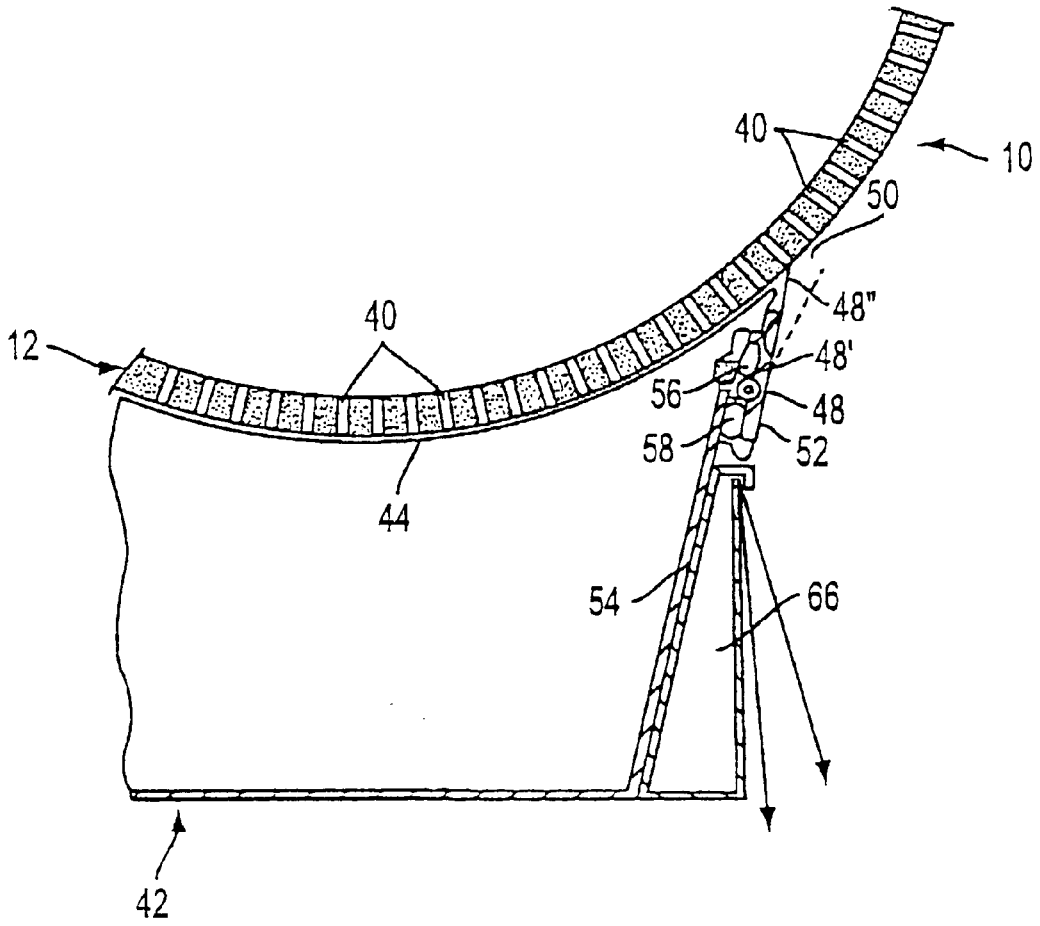
FIG. 3 is an enlarged depiction of a sealing strip, which is disposed in the exit region of the carrying drum belonging to the winding machine shown in FIG. 2, is simultaneously embodied as a doctor, and is followed by a blower device.

In a purely schematic representation, FIGS. 2 and 3 show an exemplary embodiment of a winding machine 10 according to the invention, which is for winding a material web 14 onto a reel 12. The material web 14 can be a paper or cardboard web. The winding machine can be provided at the end of such a paper making machine.

In order to produce a winding roll 30, the material web 14 is guided by means of a spreader roll 24 and then by means of a carrying drum 12, which forms a nip 18 with an empty reel 16' or with the currently produced winding roll 30 of an already wound reel 16. In the normal case, i.e., with the exception of certain special papers for which free winders are used, the carrying drum 12 and the winding roll 30 being produced are kept in contact with each other during the winding process in order to maintain this nip 18.

Figure 1:
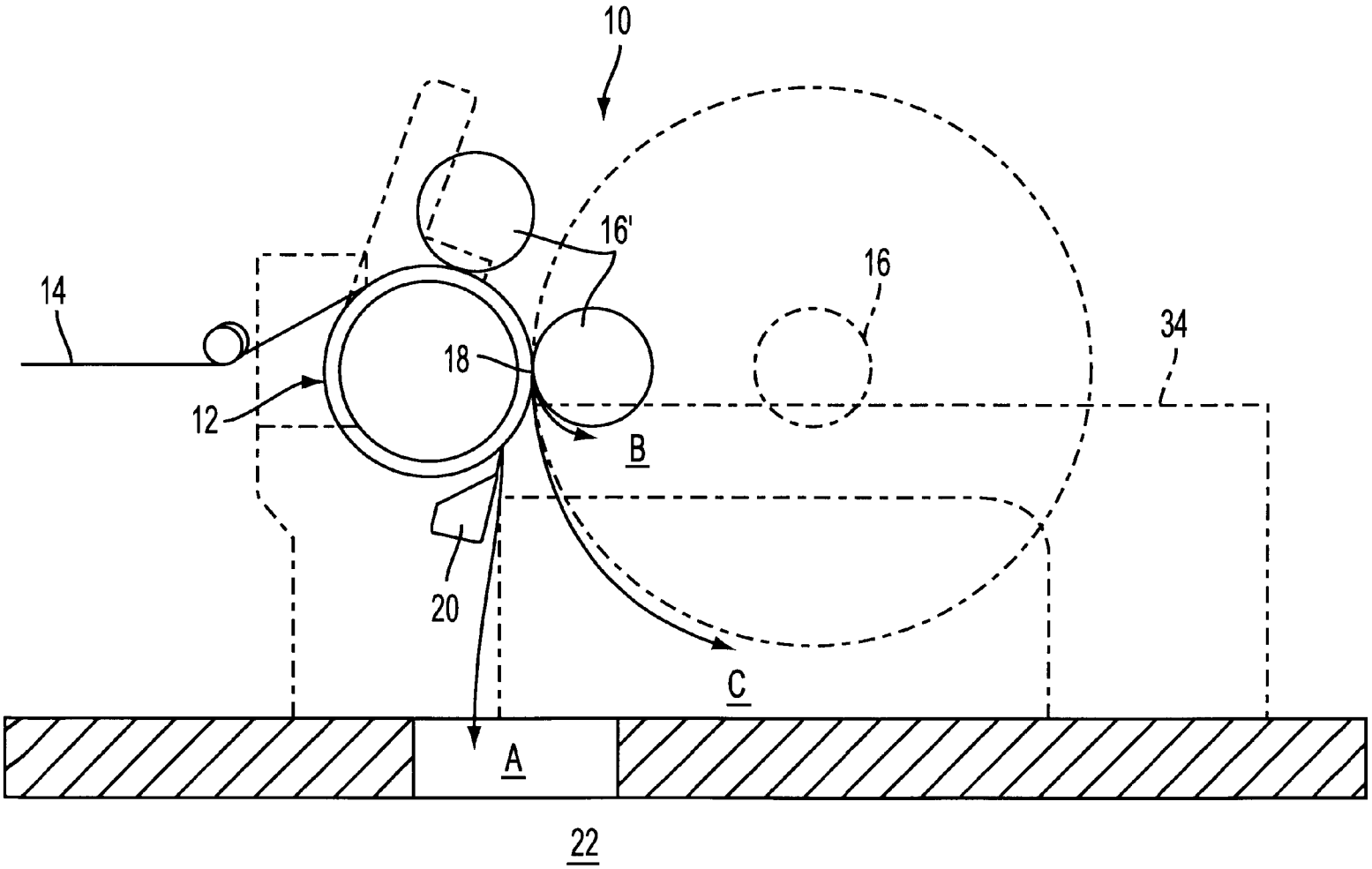
FIG. 1 (PRIOR ART)
FIG. 1 shows a conventional winding machine that has a carrying drum with internal suction.

The next, still empty reel 16' is kept at the ready in a primary lever 26. The reel 16' can be acted upon by a primary drive 28, by means of which it can be set into rotation, in the primary lever 26. The primary drive 28 can be moved along a first guide path that is defined by means of the primary lever 26, The winding machine 10 also includes a secondary support 32 which can have a transport device that can be moved on a linear guide. Such a transport device is then used to secure and guide a respective reel 16. Furthermore, rails 34 can be provided, only one of which can be seen in FIG. 1. These rails 34 are disposed parallel to the horizontal and are fastened to a machine flame 36. Consequently, a reel 16 that is provided with support devices can be moved on the rails 34, which means that the weight of the reel 16 or the winding roll 30 being produced is absorbed by these rails 34.

Consequently, in the exemplary embodiment depicted, the winding roll 30 being produced can be moved together with the associated reel 16 by means of a corresponding transport device along a second guide path parallel to the rails 34, which extends essentially horizontally.

The reel 16 can be acted upon by means of a secondary drive 38, by means of which it is set into rotation inside the secondary support 32. The secondary drive 38 which is provided as a central drive in the current instance, can be moved along the second guide path parallel to the rails 34.

The carrying drum 12, which again can be driven by a central drive, is used in the current instance as a press drum, such that it can be moved, for example, by a guide carriage parallel to the rails 34 of the secondary support 32. In the current case, the carrying drum 12 and the winding roll 30 with the associated reel 16 are moved in the same plane.

The line force in the nip 18 can be adjusted in the desired manner particularly by way of a corresponding pressure of the carrying drum 12 against the reel 16 or the winding roll produced on it. A corresponding compensation for the increasing winding diameter can be carried, out, among other things, by a corresponding movement of the winding roll 30 along the rails 34.

In particular, it is also possible to have a Pope roller in which the carrying drum is stationary.

As can be inferred in particular from FIG. 3, the casing of the carrying roll 16 can be thoroughly provided with holes 40 and can be supplied with suction by way of an external suction box 42. This suction box 42 is disposed with its suction opening 44 opposite from the circumference region of the carrying drum 12 that is not sapped by the material web 14. This suction box 42 extends laterally to the web travel direction L, at least essentially across the entire machine width. On its two longitudinal sides, it is sealed in relation to the outside by sealing strips 46, 48 that are provided in the vicinity of the suction opening 44 and cooperate with the carrying drum 12. In addition, corresponding sealing elements are also provided on the two end faces of the suction box 42.

According to FIG. 2, the material web 14 has already been guided by the carrying drum 12 with its strip-like threading end. In an exit region 50, the material web 14 is again detached from the carrying drum 12 and is discarded into a rejects slusher 22.

As can be inferred in particular from FIG. 3, the casing of the carrying drum 12 can be thoroughly provided with holes 40 and can be supplied with suction by way of an external suction box 42. This suction box 42 is disposed with its suction opening 44 opposite from the circumference region of the carrying drum 12 that is not wrapped by the material web 14. This suction box 42 extends laterally to the web travel direction L, at least essentially across the entire machine width. On its two longitudinal sides, it is sealed in relation to the outside by sealing strips 46, 48 that are provided in the vicinity of the suction opening 44 and cooperate with the carrying drum 12. In addition, corresponding sealing elements are also provided on the two end faces of the suction box 42.

According to FIG. 3, the sealing strip 48, which is provided in the exit region 50 and is simultaneously used as a doctor, has a base body 48', which can be pivoted around an axis 52 parallel to the drum axis and is supported on a side wall 54 of the suction box 42, and has a doctor blade 48" that is inserted into this base body 48'. The base body 48' can be acted upon in opposite directions by two compressed air hoses 56, 58. The two compressed air hoses 56, 58 are disposed on opposite sides of the axis 52, wherein the sealing strip 48, which is simultaneously used as a doctor, can be pressed against the carrying drum 12 by the compressed air hose 58, while it can be acted upon in the direction away from the carrying drum 12 by the other compressed air hose 56. Consequently, the respective pressure with which the sealing strip 48 is held against the carrying drum 12 can also be adjusted by these two compressed air hoses 56, 58.

As can be seen from FIG. 2, the suction box 42 can have vacuum applied to it through an internal tube 64 that is provided with suction openings 62 and can be connected to a vacuum source 60. In the current instance, this internal tube 64 also extends at least essentially across the entire machine width.

The suction openings 62 provided in the casing of the internal tube 64 can be disposed on the side of the tube 64 oriented toward the carrying drum 12.

In order to assure as optimal as possible a transfer of the strip-like threading end of the material web 14 as well, the carrying drum 12 and the suction box 42 can be correspondingly subdivided to form an edge suction zone provided in the vicinity of the relevant drum end. In this connection, the internal tube 64 is alternatively used to apply suction either to only the edge suction zone or to the entire suction zone that extends at least essentially across the entire machine width.

As can be seen in particular from FIG. 3, a blower device 66 is provided in the web exit region 50, which assists the material web 14 or the threading end of the material web 14 to detach from the carrying drum 12. In the current instance, this blower device 66 is also disposed on the side wall 54 of the blow box 42.

Since the suction opening 44 of the outer suction box 42 which opening is defined by the sealing elements 46, 48, extends over at least essentially the entire circumference region of the carrying drum 12 that is not wrapped by the material web 14, secondary air is completely prevented from penetrating into the inner chamber of the suction box 42, which keeps energy consumption low. The danger of an uncontrolled self-threading of the threading end or the entire material web 14 onto the still empty reel 16' or the winding roll of an already wound reel 16 is also prevented as a result of the carrying drum 12 being externally supplied with suction. A respective changing of the seals is possible in an extremely simple fashion. It is no longer necessary to remove the carrying drum 12 for this purpose. Since the sealing strip 48 is simultaneously embodied as a doctor, the previously required additional doctor device is also eliminated.

After the material web 14 has been widened out starting with the web path shown in FIG. 2, it can then be threaded onto an empty reel 16'. An uncontrolled self-threading is thus prevented. An uncontrolled self-threading onto an already wound reel is also prevented in a practical fashion.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather the present invention extends to all functionally equivalent structures, methods and uses, such as are within the scope of the appended claims.

LIST OF REFERENCE CHARACTERS

10 winding machine
12 carrying drum
14 material web
16 wound reel
16' empty reel
18 nip
20 doctor
22 rejects slusher
24 spreader roll
26 primary lever
28 primary drive
30 winding roll
32 secondary support
34 rails
36 machine frame
38 secondary drive
40 holes
42 external suction box
44 suction opening

46 sealing strip
48 sealing strip
48' base body
48" doctor blade
50 exit region
52 axis
54 side wall
56 compressed air hose
58 compressed air hose
60 vacuum source
62 suction openings
64 tube
66 blower device

What is claimed is:

1. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web; and at least one sealing element associated with the suction box and cooperating with the carrying drum in the vicinity of this suction opening, wherein said at least one sealing element comprises at least one of (a) a doctor and (b) at least one of a movable and controllable sealing element.

2. The winding machine of claim 1, wherein the material web comprises one of, a paper web or cardboard web.

3. The winding machine according to claim 1, wherein said at least one sealing element comprises a doctor and at least one of a movable and controllable sealing element.

4. The winding machine according to claim 3, wherein said doctor is provided in a web exit region of the carrying drum to again detach at least a threading end of the material web from the carrying drum.

5. The winding machine according to claim 1, wherein said at least one sealing element comprises a sealing strip that extends laterally to a direction of travel of the web.

6. The winding machine according to claim 5, further comprising a pneumatic loader for said at least one sealing strip in the web exit region.

7. The winding machine according to claim 1, comprising sealing strips, on both longitudinal sides of the suction box, extending laterally to the web travel direction.

8. The winding machine according to claim 7, wherein the suction box is sealed on both sides by said sealing strips which also serve as doctors.

9. The winding machine according to claim 1, wherein the suction box extends laterally to a direction of travel of the web, at least substantially across the entire machine width.

10. The winding machine according to claim 1, further comprising a vacuum source and an internal tube located within the suction box, with suction openings connected to the suction box.

11. The winding machine according to claim 10, wherein the internal tube extends at least substantially across the entire machine width.

12. The winding machine according to claim 10, wherein the suction openings are provided in the casing of the internal tube on the side of the tube oriented toward the carrying drum.

13. The winding machine according to claim 1, further comprising a blower device in a web exit region for assisting at least the threading end of the material web to detach from the carrying drum.

14. The winding machine according to claim 1, wherein the suction opening extends over at least essentially the entire circumference region of the carrying drum that is not wrapped by the material web.

15. The winding machine according to claim 1, wherein the carrying drum is associated with a zone-controlled internal support.

16. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening, the at least one sealing element comprising a sealing strip that extends laterally to a direction of travel of the web; and a pneumatic loader for said at least one sealing strip in the web exit region, wherein said pneumatic loader comprises at least one compressed air hose for pressing the at least one sealing strip against the carrying drum.

17. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening, the at least one sealing element comprising a sealing strip that extends laterally to a direction of travel of the web; and a pneumatic loader for said at least one sealing strip in the web exit region, wherein said pneumatic loader comprises at least one compressed air hose acting upon the at least one sealing strip in a direction away from the carrying drum.

18. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening, the at least one sealing element comprising a sealing strip that extends laterally to a direction of travel of the web;

a pneumatic loader for said at least one sealing strip in the web exit region; and two compressed air hoses for acting in opposite directions on the said at least one sealing strip, the said at least one sealing strip being pivotable around an axis parallel to the drum axis and being supported on a side wall of the suction box.

19. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening; and a vacuum source and an internal tube provided with suction openings connected to the suction, wherein the suction openings are provided in the casing of the internal tube on the side of the tube oriented toward the carrying drum, wherein the internal tube is alternatively used to apply vacuum either to only the edge suction zone or to the entire suction zone that extends at least essentially across the entire machine width.

20. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web; and at least one sealing element associated with the suction box and cooperating with the carrying drum in the vicinity of this suction opening, wherein the carrying drum has two drum ends, the drum and the suction box being correspondingly subdivided in order to form an edge suction zone in the vicinity of one of the drum ends.

21. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening; and a blower device in a web exit region for assisting at least the threading end of the material web to detach from the carrying drum, wherein the blower device is disposed on a side wall of the suction box.

22. A winding machine for winding a material web onto a reel, the machine comprising:

a carrying drum for guiding said material web;

a nip formed between the carrying drum and the reel;

the carrying drum having at least one of, a perforated casing, or circumferential grooves;

at least one external suction box for supplying suction to the drum;

at least one suction opening opposite the circumference region of the carrying drum that is not wrapped by the material web;

at least one sealing element associated with the suction box and cooperating with the carrying drum in the vicinity of this suction opening;

a pneumatic loader for said that at least one sealing strip in a web exit region, said pneumatic loader comprising at least one compressed air hose for pressing the at least one sealing strip against the carrying drum and at least one compressed air hose acting upon the at least one sealing strip in a direction away from the carrying drum;

a vacuum source and an internal tube provided with suction openings connected to the suction box; and a blower device in the web exit region for assisting at least the threading end of the material web to detach from the carrying drum, the blower device being disposed on a side wall of the suction box.

23. A process for winding a material web onto a reel comprising:

guiding said material web onto a carrying drum;

moving the reel adjacent the carrying drum to form a nip between the carrying drum and the reel, wherein the carrying drum has at least one of, a perforating casing, or circumferential grooves on the carrying drum;

supplying suction to the drum from at least one external suction box through at least one suction opening opposite the circumference region of the carrying drum that is not wrapped by the material web, wherein at least one sealing element associated with the suction box cooperates with the carrying drum in the vicinity of this suction opening, said at least one sealing element serving as at least one of (a) a doctor and (b) at least one of a movable and controllable sealing element.

24. The process according to claim 23, wherein said at least one sealing element serves as a doctor and at least one of a movable and controllable sealing element to again detach at least a threading end of the material web from the carrying drum.

25. The process according to claim 23, further comprising pneumatically loading at least one sealing strip in a web exit region.

26. The process according to claim 25, further comprising pivoting said at least one sealing strip around an axis parallel to the drum axis and supporting said sealing strip on a side wall of the suction box.

27. The process according to claim 23, further comprising connecting a vacuum source and an internal tube located within the suction box, with suction openings to the suction box.

28. The process according to claim 23, further comprising applying a detaching force to the threading end of the material web from the carrying drum by way of a blower device in the web exit region.

29. A process for winding a material web onto a reel comprising:

guiding said material web onto a carrying drum;

moving the reel adjacent the carrying drum to form a nip between the carrying drum and the reel, wherein the carrying drum has at least one of, a perforating casing, or circumferential grooves on the carrying drum;

supplying suction to the drum from at least one external suction box through at least one suction opening opposite the circumference region of the carrying drum that is not wrapped by the material web, wherein at least one sealing element associated with the suction box cooperates with the carrying drum in the vicinity of this suction opening; and pneumatically loading at least one sealing strip in a web exit region, wherein said pneumatic loading comprises pressing the at least one sealing strip against the carrying drum by way of at least one compressed air hose.

30. A process for winding a material web onto a reel comprising:

guiding said material web onto a carrying drum;

moving the reel adjacent the carrying drum to form a nip between the carrying drum and the reel, wherein the carrying drum has at least one of, a perforating casing, or circumferential grooves on the carrying drum;

supplying suction to the drum from at least one external suction box through at least one suction opening opposite the circumference region of the carrying drum that is not wrapped by the material web, wherein at least one sealing element associated with the suction box cooperates with the carrying drum in the vicinity of this suction opening; and pneumatically loading at least one sealing strip in a web exit region, wherein said pneumatic loading comprises acting upon the at least one sealing strip in a direction away from the carrying drum by way of at least one compressed air hose.

31. A process for winding a material web onto a reel comprising:

guiding said material web onto a carrying drum;

moving the reel adjacent the carrying drum to form a nip between the carrying drum and the reel, wherein the carrying drum has at least one of, a perforating casing, or circumferential grooves on the carrying drum;

supplying suction to the drum from at least one external suction box through at least one suction opening opposite the circumference region of the carrying drum that is not wrapped by the material web, wherein at least one sealing element associated with the suction box cooperates with the carrying drum in the vicinity of this suction opening; and pneumatically loading at least one sealing strip in a web exit region, wherein said pneumatic loading comprises acting in opposite directions on the said at least one sealing strip by way of two compressed air hoses.

32. A process for winding a material web onto a reel comprising:

guiding said material web onto a carrying drum;

moving the reel adjacent the carrying drum to form a nip between the carrying drum and the reel, wherein the carrying drum has at least one of, a perforating casing, or circumferential grooves on the carrying drum;

supplying suction to the drum from at least one external suction box through at least one suction opening opposite the circumference region of the carrying drum that is not wrapped by the material web, wherein at least one sealing element associated with the suction box cooperates with the carrying drum in the vicinity of this suction opening;

connecting a vacuum source and an internal tube provided with suction openings to the suction box; and alternatively applying vacuum either to only the edge suction zone or to the entire suction zone that extends at least essentially across the entire machine width.

* * * * *